US008108950B1

(12) United States Patent
Bowersox-Evans

(10) Patent No.: US 8,108,950 B1
(45) Date of Patent: Feb. 7, 2012

(54) CROTCHLESS UNDERWEAR

(76) Inventor: Katherine Ann Bowersox-Evans, North Port, FL (US)

( * ) Notice: Subject to any disclaimer, the term of this patent is extended or adjusted under 35 U.S.C. 154(b) by 281 days.

(21) Appl. No.: 12/417,970

(22) Filed: Apr. 3, 2009

Related U.S. Application Data

(60) Provisional application No. 61/123,192, filed on Apr. 7, 2008.

(51) Int. Cl.
*A41B 9/04* (2006.01)

(52) U.S. Cl. ..... 2/406; 2/407; 2/408; D2/712

(58) Field of Classification Search ..... 2/406, 407, 2/408; D2/712
See application file for complete search history.

(56) References Cited

U.S. PATENT DOCUMENTS 2,088,800 A * 8/1937 Malouf ..... 2/406
4,229,835 A 10/1980 Shaw
5,174,307 A 12/1992 Thompson
5,239,706 A * 8/1993 Stevenson ..... 2/408
5,483,705 A 1/1996 DiMatteo
D419,280 S * 1/2000 Hines ..... D2/712
6,560,786 B2 5/2003 Lipton
D528,739 S * 9/2006 Williamson ..... D2/712
D554,826 S * 11/2007 Hart ..... D2/704
7,716,753 B2 * 5/2010 Franko ..... 2/406
2005/0009446 A1 1/2005 Arnold
2005/0010994 A1 1/2005 Lee
2008/0276353 A1 * 11/2008 Franko ..... 2/406

* cited by examiner

*Primary Examiner* — Khoa Huynh
*Assistant Examiner* — Alissa Tompkins
(74) *Attorney, Agent, or Firm* — Charles J. Prescott

(57) ABSTRACT

Underpants particularly worn during intercourse which include a front panel, a rear panel, and side panels interconnecting and extending between the front and rear panels. Leg straps interconnect and extend between respective lower corners of the front and rear panels. Lower margins of the front, rear and side panels collectively define an open crotch area while padding arranged over a lower area of the front panel protectively covers a symphysis pubis area of the wearer during intercourse.

2 Claims, 4 Drawing Sheets

CROTCHLESS UNDERWEAR

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to undergarments, and more particularly to underpants-type undergarments specifically provided to be worn by women to protectively cover the symphysis pubis rami area from contact with other objects and still more particularly to providing comfort to this area during sexual intercourse by eliminating the crotch from such undergarments.

2. Description of Related Art

During pregnancy or childbirth, a large percentage of women experience intense pelvic pain and may find it difficult to walk, climb stairs and other movements that involve the pelvic bones. This pain is a result of separation of the symphysis pubis which is a soft joint in the very front part of the pelvic bone structure. Cartilage fills the gap between the pelvic bones and, during pregnancy, hormones such as relaxin, soften this cartilage along the pelvic bones to be more flexible for delivery. Some women, however, have too much play in the pelvic area causing a large gap between the bones. This makes the symphysis pubis area quite sensitive to touch. Moreover, this area can become extremely painful, making sexual intercourse after childbirth extremely painful. In addition, some women who suffer from weak and tender bones due to bone degenerate diseases would tend to benefit from this product, being that the main bone contact during sexual intercourse is between the male and female frontal pubic bones A number of prior art devices are intended to provide unique covering and protective features for the female anatomy in this area of the torso.

U.S. Patent Application Publication 2005/0009446 to Arnold discloses underwear which is free of seams in the crotch area. Lipton teaches quick release and refastenable underwear in U.S. Pat. No. 6,560,786. A device for shielding and protecting the pelvic and crotch area of a human female is taught by Thompson in U.S. Pat. No. 5,174,307.

Shaw teaches padded underwear for athletic activities in U.S. Pat. No. 4,229,835. A female athletic protective system is taught by DiMatteo in U.S. Pat. No. 5,483,705.

The present invention provides still further uniquely configured underpants for women experiencing symphysis pubis dysfunction as a result of pregnancy or childbirth. A padded area is incorporated into the lower front panel of the underpants to cover this sensitive area of the anatomy and, by providing a crotchless structure, the underpants may be worn during sexual intercourse to protect this area from high-pressure contact normally experienced and which would thus otherwise cause great discomfort.

The foregoing examples of the related art and limitations related therewith are intended to be illustrative and not exclusive. Other limitations of the related art will become apparent to those skilled in the art upon a reading of the specification and a study of the drawings.

BRIEF SUMMARY OF THE INVENTION

This invention is directed to underpants particularly worn during intercourse which include a front panel, a rear panel, and side panels interconnecting and extending between the front and rear panels. Leg straps interconnect and extend between respective lower corners of the front and rear panels. Lower margins of the front, rear and side panels collectively define an open crotch area while padding arranged over a lower area of the front panel protectively covers a symphysis pubis area of the wearer during intercourse.

It is therefore an object of this invention to provide a form of external protective relief for women who are experiencing symphysis pubis dysfunction and resulting from painful irritation of this area when contacted by other objects.

Still another object of this invention is to provide uniquely configured underpants which may be worn during sexual intercourse while still protecting the irritated symphysis pubis area of women who are pregnant or have recently experienced childbirth and have developed intense soreness to touch in this area.

The following embodiments and aspects thereof are described and illustrated in conjunction with systems, tools and methods which are meant to be exemplary and illustrative and not limiting in scope. In various embodiments one or more of the above-described problems have been reduced or eliminated while other embodiments are directed to other improvements. In addition to the exemplary aspects and embodiments described above, further aspects and embodiments will become apparent by reference to the drawings and by study of the following descriptions.

BRIEF DESCRIPTION OF THE SEVERAL VIEWS OF THE DRAWING(S)

Exemplary embodiments are illustrated in reference figures of the drawings. It is intended that the embodiments and figures disclosed herein are to be considered to be illustrative rather than limiting.

DETAILED DESCRIPTION OF THE INVENTION

Figure 1:
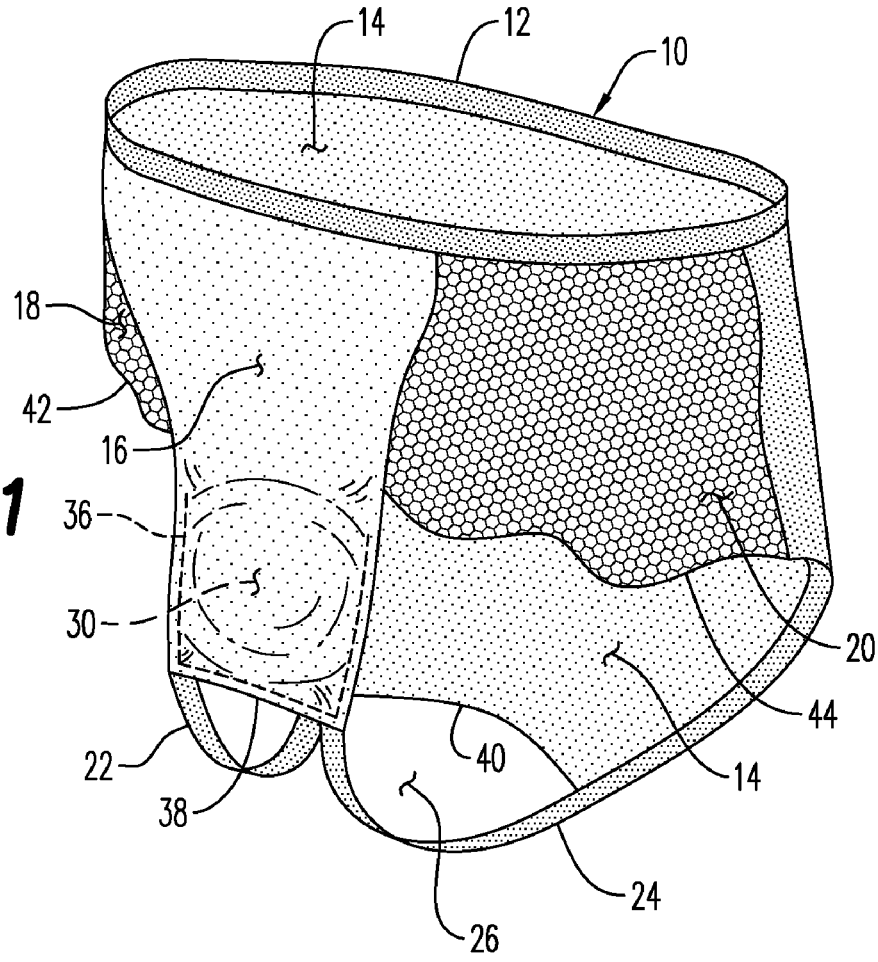
FIG. 1 is a perspective view of the invention.
Figure 2:
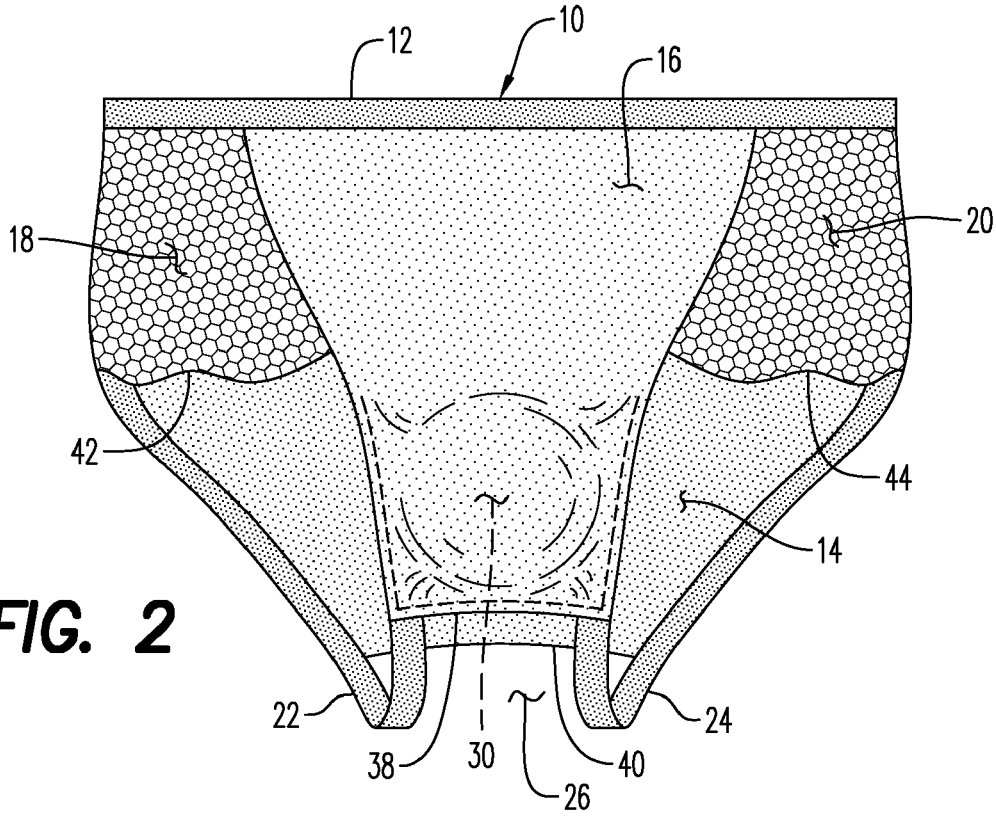
FIG. 2 is a front elevation view of FIG. 1.
Figure 3:
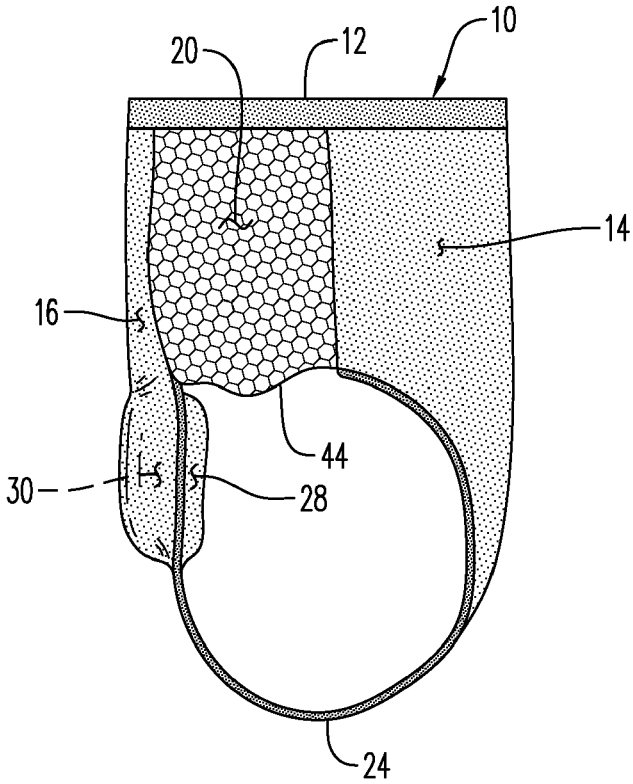
FIG. 3 is a side elevation view of FIG. 1.

Referring now to the drawings, and first to FIGS. 1 to 3, the preferred embodiment of the invention is there shown generally at numeral 10 and includes an upper torso waistband 12 forming the upper margins of laterally edge-connected front panel 16, side panels 18 and 20, and back panel 14. Each of these panels are formed of flexible stitchable fabric material of a suitable nature to be worn as an underpants garment.

The front panel 16 extends downwardly from the waistband 12 to a lower margin 38 thereof. Likewise, the back panel 14 terminates at lower margin 40, while the side panels 18 and 20, terminate at lower margins 42 and 44, respectively.

These lower margins 38, 40, 42 and 44 collectively define an open crotch area 26 which leaves the genital area of the female wearer exposed.

To hold the front panel 16 and the back panel 14 together against the torso of the wearer, flexible fabric leg straps 22 and 24 extend between the respective lower corners of each of these panels 16 and 14. These straps 24 encircle the thigh area of the wearer to hold the panels of the underpants 10 in position against the corresponding areas of the torso.

Figure 4:
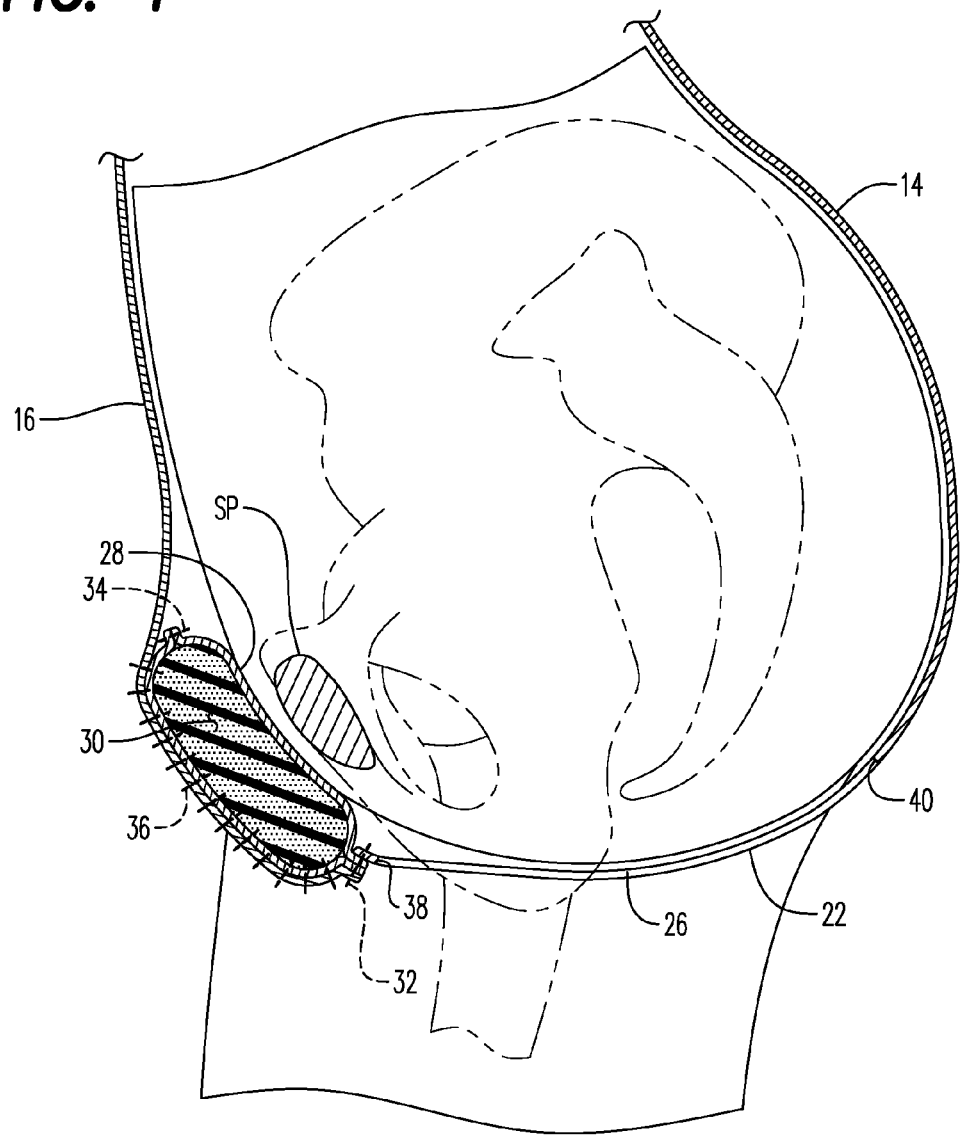
FIG. 4 is a cross-section view of FIG. 1 in the worn position over the lower torso showing pertinent parts of the female anatomy in phantom.

As best seen also in FIG. 4, a compressible padding arrangement 30 is sewn into place against the inner surface of the lower portion of the front panel 16. A flexible covering 28 is stitched together at 32 and 34, the end areas of the padding 30, while spaced stitching 36 connects the front half of the flexible cover 28 against the inner side of the lower portion of front panel 16.

Figure 5:
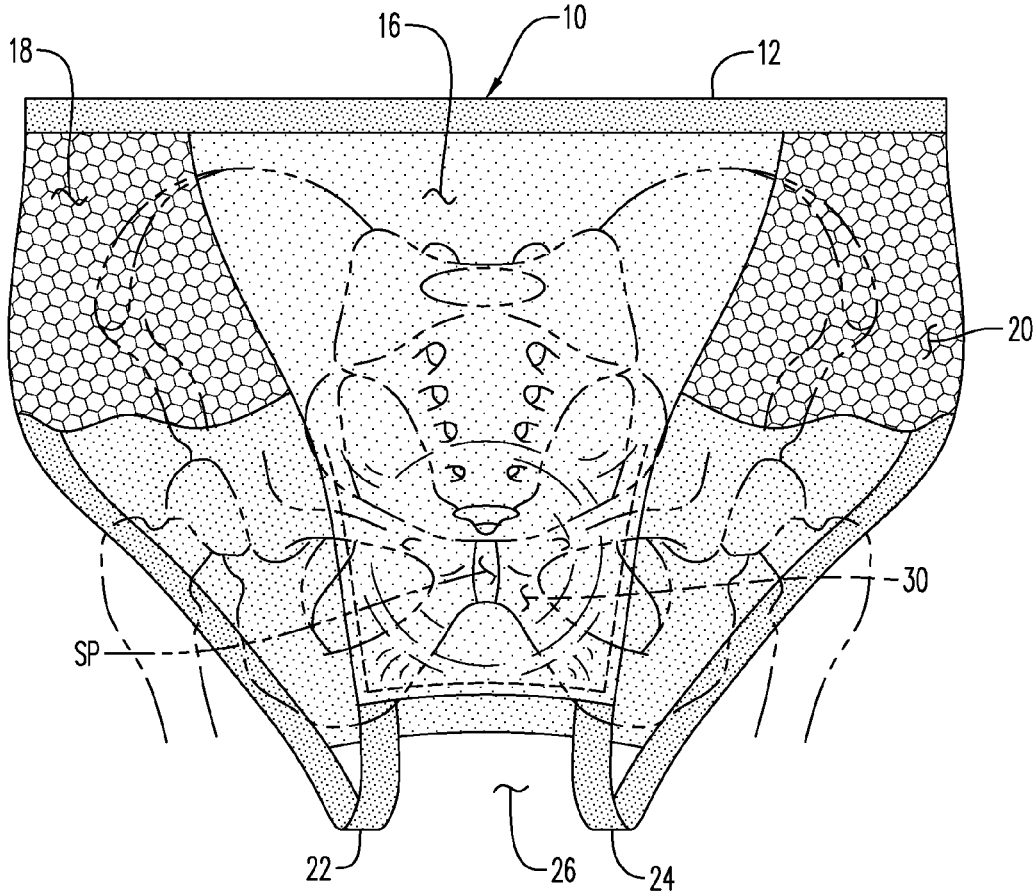
FIG. 5 is a front elevation view similar to FIG. 2 showing the associated parts of the female anatomy in phantom.

Still referring to FIGS. 4 and 5, when the underpants 10 are properly worn, the padding 30 is positioned to cover the symphysis pubis SP area of the female anatomy which, as described in the background, can become extremely sensitive to any form of touch. Thus, during normal physical contact during sexual intercourse, this symphysis pubis SP area is covered by the padding 30 sufficiently so as to relieve any discomfort to touch or pressure which would otherwise occur during this activity.

While a number of exemplary aspects and embodiments have been discussed above, those of skill in the art will recognize certain modifications, permeations and additions and subcombinations thereof. It is therefore intended that the following appended claims and claims hereinafter introduced are interpreted to include all such modifications, permeations, additions and subcombinations that are within their true spirit and scope.

The invention claimed is:

1. Underpants particularly worn during intercourse comprising:

a front panel;

a rear panel;

side panels interconnecting and extending between said front and rear panels;

leg straps interconnecting and extending between respective lower corners of said front and rear panels;

lower margins of said front, rear and side panels collectively defining an open crotch area leaving a genitalia of a wearer exposed;

a compressible padding substantially thicker than said panels and having a flexible covering encapsulating said padding, said covering stitched in place with said padding against an inner surface of a lower area of said front panel;

said entire padding positioned on said front panel to protectively cover only a symphysis pubis area of the wearer.

2. Underpants comprising:

a front panel of flexible material having a top edge forming a front portion of a substantially continuous waistband and extending downwardly toward, but not to a crotch area of a wearer;

a rear panel of flexible material having a top edge forming a rear portion of the waistband and extending downwardly over a buttocks area of the wearer toward, but not to the crotch area;

left and right side panels of flexible material connected to and extending between respective margins of said front and rear panels, each of said side panels having a top edge forming side portions of the waistband;

left and right leg straps of flexible material interconnecting and extending between respective outer lower portions of said front and rear panels and encircling a respective thigh of the wearer;

lower margins of said panels defining an open crotch area;

a thick, compressible pad having a flexible cover, said cover stitchingly connected against an inner surface of a lower end of said front panel, said entire pad being positioned directly over only a symphysis pubis area of the wearer.

* * * * *